US007555247B2

(12) United States Patent
Suenami et al.

(10) Patent No.: US 7,555,247 B2
(45) Date of Patent: Jun. 30, 2009

(54) TONER CONVEYING DEVICE, DEVELOPING DEVICE, AND IMAGE FORMING DEVICE HAVING THE SAME

(75) Inventors: Koji Suenami, Osaka (JP); Hiroyuki Hamakawa, Osaka (JP); Takaaki Kamei, Osaka (JP); Asami Kotera, Osaka (JP); Yoshihiro Yamagishi, Osaka (JP); Eiji Nimura, Osaka (JP); Takahiko Murata, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 304 days.

(21) Appl. No.: 11/277,362

(22) Filed: Mar. 24, 2006

(65) Prior Publication Data

US 2006/0222408 A1 Oct. 5, 2006

(30) Foreign Application Priority Data

Mar. 25, 2005 (JP) ..... 2005-089217

(51) Int. Cl.
*G03G 15/08* (2006.01)

(52) U.S. Cl. ..... 399/254

(58) Field of Classification Search ..... 399/254–256
See application file for complete search history.

(56) References Cited

U.S. PATENT DOCUMENTS 5,734,952 A * 3/1998 Murakami et al. ..... 399/255
6,055,405 A * 4/2000 Knott et al. ..... 399/358
6,832,067 B2 * 12/2004 Kubo ..... 399/350

FOREIGN PATENT DOCUMENTS

| | | | |
|---|---|---|---|
| JP | 55161738 A | * | 12/1980 |
| JP | 04036785 A | * | 2/1992 |
| JP | 05224562 A | * | 9/1993 |
| JP | 2001-42733 A | | 2/2004 |
| JP | 2004/177754 A | | 6/2004 |
| JP | 2006126412 A | * | 5/2006 |

* cited by examiner

*Primary Examiner*—David M Gray
*Assistant Examiner*—Erika Villaluna
(74) *Attorney, Agent, or Firm*—Shinjyu Global IP

(57) ABSTRACT

A developing device includes a container for containing toner, a rotatable shaft provided in the container, a spiral shaped blade formed on an outer circumference of the shaft, and a first spiral member for conveying the toner in the longitudinal direction of the shaft by means of rotation. In addition, a toner removing member is provided for removing the toner attached to the first spiral member. Then, by rotation of the first spiral member, the toner removing member is moved in the longitudinal direction of the shaft and the direction that is orthogonal to the longitudinal direction of the shaft so as to be in contact with the surface of the first spiral member. Accordingly, it is possible to adequately scrape the toner off the spiral shaped blade and the shaft, thereby effectively prevent an aggregation of toner from occurring.

18 Claims, 14 Drawing Sheets

TONER CONVEYING DEVICE, DEVELOPING DEVICE, AND IMAGE FORMING DEVICE HAVING THE SAME

BACKGROUND OF THE INVENTION

1. Field of the Invention

The present invention relates to a toner conveying device. More specifically, the present invention relates to a toner conveying device capable of preventing the aggregation or cohesion of toner from occurring. In addition, the present invention relates to a developing device which develops an image with magnetic toner (hereinafter, referred to as "toner") by means of an electrophotographic developing method. More specifically, the present invention relates to a developing device which prevents the aggregation of toner from occurring, and an image forming device having the same.

2. Background Information

Generally, in an image forming device in an electrophotographic developing method, such as printers, facsimiles, and copying machines, a developing device is provided for containing developer with which an electrostatic latent image formed on a surface of a photoconductor on the basis of original image data is developed into a toner image.

Here, in such a conventional developing device, if toner fluidity in the developing device has deteriorated, toner conveyance performance will be lowered such that the toner is apt to accumulate in a toner container. As a result, following an extended period of use, the toner accumulated in the container will clump together, and the aggregated toner will attach to a spiral member therein having a spiral shaped blade. Even if the toner is agitated, the aggregated state of the toner will not be eliminated, and will result in the occurrence of abnormal images, such as toner fogging. This type of problem also arises in an image forming device with a toner recycle mechanism in which residual toner on a photoconductor (an image support member) is removed by a cleaning device, and then returned to a developing device through a toner conveyance device utilizing a conveyance screw so as to be recycled.

A variety of image forming devices have been proposed in order to solve the above described problems. For example, the device disclosed in Japan Unexamined Patent Publication No. 2004-177754 has a rotary drive type conveying means for returning toner removed by a cleaning device to a developing device, and a toner smashing member for smashing aggregated toner remaining in the recycled toner. The toner smashing member is made of an elastic film sheet (PET film sheet), and has a tong member which is deformed by a force applied from outside during the rotation of a rotary driving type conveying means having a spiral shape. Thus, the toner smashing member having the tong member smashes the aggregated toner.

However, in the above-described conventional image forming device, the toner smashing member is designed to move only in the direction in which the spiral shaped blade of the rotary driving type conveying means travels (that is, the smashing member is elastically deformed only in the longitudinal direction of the shaft of the rotary driving type conveying means), and therefore, it is impossible to adequately scrape toner off the spiral shaped blade and the shaft of the rotary driving type conveying means. As a result, a conventional image forming device is unable to adequately reduce the occurrence of toner aggregation.

In view of the above, it will be apparent to those skilled in the art from this disclosure that there exists a need for an improved toner conveying device, a developing device, and an image forming device having the same, which are able to prevent the occurrence of toner aggregation with a simple structure. This invention addresses this need in the art as well as other needs, which will become apparent to those skilled in the art from this disclosure.

SUMMARY OF THE INVENTION

A toner conveying device according to the present invention conveys toner in one direction, and comprises a container for containing toner, a spiral member, and a toner removing member. The spiral member has a rotatable shaft provided within the container and a spiral shaped blade formed on an outer circumference of the shaft, and conveys the toner in the longitudinal direction of the shaft by means of rotation. The toner removing member is capable of contacting the surface of the spiral member, and removes toner attached to the spiral member by rotation of the spiral member.

In one aspect of the toner conveying device according to the present invention, the toner removing member is made of an elastic metal wire.

In this case, the durability of the toner removing member to a force applied while the spiral member rotates is improved, in comparison with the elastic film sheet of the conventional art, thereby increasing the life of the toner removing member.

A developing device according to another aspect of the present invention forms a toner image on an image support member provided in an image forming unit of an image forming device, and includes a container for containing toner, a developing roller supported in the container for supplying the image support member with toner, a spiral member, and a toner removing member. The spiral member has a rotatable shaft provided within the container, and a spiral shaped blade formed on an outer circumference of the shaft, and conveys the toner in the longitudinal direction of the shaft by means of rotation. The toner removing member is capable of contacting the surface of the spiral member, and removing toner attached to the spiral member by means of rotation of the spiral member.

In this developing device, it is possible to adequately scrape the toner off the spiral shaped blade and the shaft, thereby effectively preventing the aggregation of toner from occurring.

In another aspect of a developing device of the present invention, the container has an agitation chamber for receiving a supply of toner and agitating the toner, and a developing chamber provided with a developing roller for guiding the toner to the surface of the photoconductor. The developing device further comprises a partition member for partitioning the container into the agitation chamber and the developing chamber such that the agitation chamber and the developing chamber are in communication with each other, and a toner removing member for removing toner attached to the partition member. The toner removing member for the partition member is capable of contacting the surface of the spiral member, and removing toner attached to the spiral member by means of the rotation of the spiral member.

In this case, it is possible to adequately scrape the toner off the surface of the partition member, thereby effectively preventing an aggregation of toner from occurring.

In another aspect of the present invention, an image forming device according to the present invention comprises a sheet feeding unit comprising a sheet storage unit for storing sheets that are dispatched from the sheet storage unit, a sheet conveyance unit for conveying a sheet from the sheet feeding unit, an image forming unit for forming a toner image on the sheet conveyed from the sheet conveyance unit, and a fixing unit for fixing the toner image formed on the sheet by the image forming unit. The image forming unit also includes an image support member having a surface on which an electrostatic latent image is formed on the basis of image data, and a developing device for forming a toner image on the image support member. The developing device includes a container for containing toner, a developing roller supported in the container for supplying the image support member with toner, a spiral member, and a toner removing member. The spiral member has a rotatable shaft provided within the container and a spiral shaped blade formed on an outer circumference of the shaft, and conveys the toner in the longitudinal direction of the shaft by means of rotation. The toner removing member is capable of contacting the surface of the spiral member, and removing toner attached to the spiral member by means of the rotation of the spiral member.

According to the present invention, it is possible to effectively reduce the occurrence of toner aggregation with a simple structure. In addition, if the toner is attached to the agitation member, the agitation performance and the conveyance performance will deteriorate such that a lock phenomenon of the toner spiral (breaking after solidification) may occur, and image failures such as white patches or white streaks caused by a phenomenon in which the toner is not distributed evenly over the image area may occur. However, the present invention can solve these problems.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
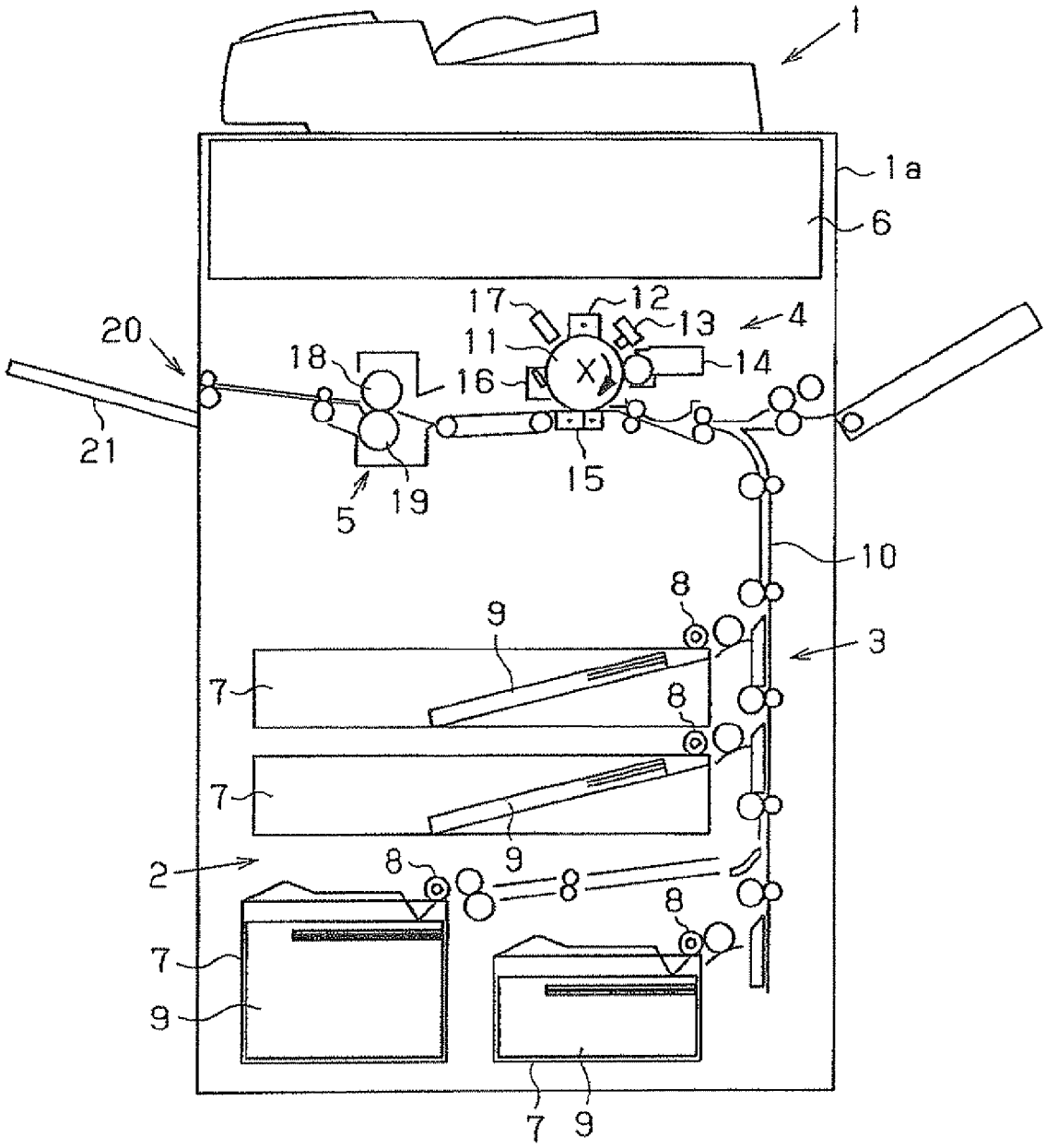
FIG. 1 is a schematic diagram showing the overall structure of an image forming device according to a first embodiment of the present invention.

A first embodiment of the present invention will be described below with reference to the drawings. FIG. 1 is a schematic diagram showing the overall structure of an image forming device according to a first embodiment of the present invention. As shown in FIG. 1, an image forming device 1 comprises a sheet feeding unit 2 placed at the bottom of an image forming device main body 1*a*, a sheet conveyance unit 3 placed on the side of and above the sheet feeding unit 2, an image forming unit 4 placed above the sheet conveyance unit 3, a fixing unit 5 placed nearer to a discharge side of the image forming device than the image forming unit 4, and an image reading unit 6 placed above the image forming unit 4 and the fixing unit 5.

The sheet feeding unit 2 is provided with a plurality of sheet feeding cassettes 7 (four in this embodiment) for storing sheets 9. Feed rollers 8 are rotated to dispatch a sheet 9 from one of the sheet feeding cassettes 7 to the sheet conveyance unit 3, allowing the sheets 9 to be reliably fed to the sheet conveyance unit 3 one by one. It should be noted that these four sheet feeding cassettes 7 are removably attached to the image forming device main body 1*a*.

The sheet 9 fed into the sheet conveyance unit 3 is conveyed toward the image forming unit 4 through a sheet conveyance path 10. The image forming unit 4 is provided in order to form a predetermined toner image on a sheet 9 by means of an electrophotographic process, and has a photoconductor 11 (an image support member) which is supported by a shaft so as to be rotatable in a predetermined direction (in the direction of the arrow x in the drawing). Around the photoconductor 11 along the rotational direction thereof are provided a charge device 12, an exposure device 13, a developing device 14, a transfer device 15, a cleaning device 16, and a discharge device 17.

The charge device 12 is provided with a charger wire to which a high voltage is applied, and a corona discharge from the charger wire applies a predetermined potential to the surface of the photoconductor 11 in order to electrostatically charge the surface of the photoconductor 11 uniformly. Then, the exposure device 13 irradiates the photoconductor 11 with light on the basis of original image data read by the image reading unit 6 in order to selectively attenuate the surface potential of the photoconductor 11. Thus, an electrostatic latent image is formed on the surface of the photoconductor 11. Next, the developing device 14 attaches toner to the electrostatic latent image in order to form a toner image on the surface of the photoconductor 11. The transfer device 15 transfers the toner image formed on the surface of the photoconductor 11 onto the sheet 9 conveyed between the photoconductor 11 and the transfer device 15.

The sheet 9 onto which the toner image is transferred is conveyed from the image forming unit 4 to the fixing unit 5. The fixing unit 5 is located downstream of the image forming unit 4 in a sheet conveyance direction. The fixing unit 5 has a heat roller 18 and a pressure roller 19 that fix the toner image on the sheet 9, the pressure roller 19 being pressed against the heat roller 18. The sheet 9 onto which the toner image is transferred by the image forming unit 4 is pinched between and heated by the heat roller 18 and the pressure roller 19. Next, the sheet 9 on which the image is formed in the image forming unit 4 and the fixing unit 5 is discharged to a copy-receiving tray 21 by a pair of discharge rollers 20.

Figure 2:
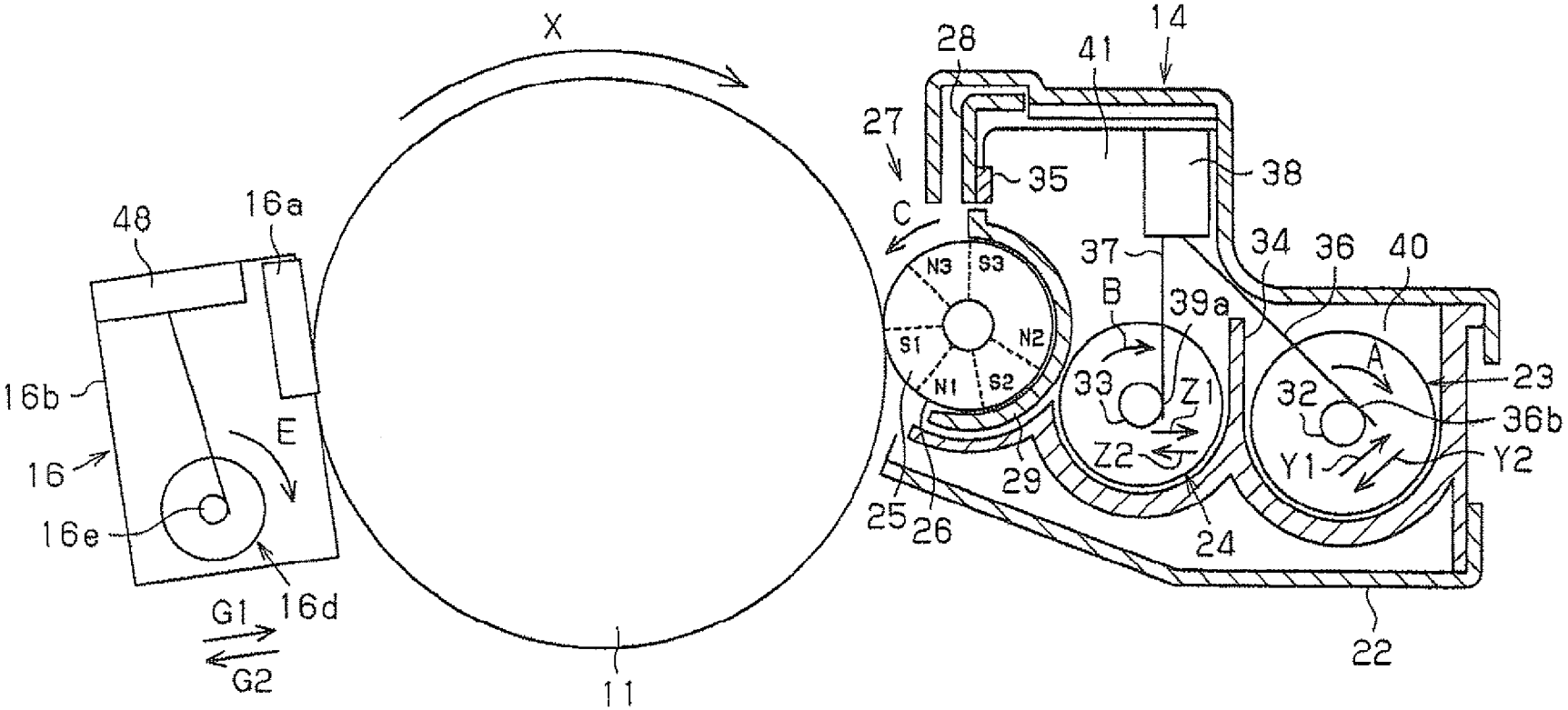
FIG. 2 is a cross-sectional view showing a developing device in the first embodiment of the present invention.
Figure 9:
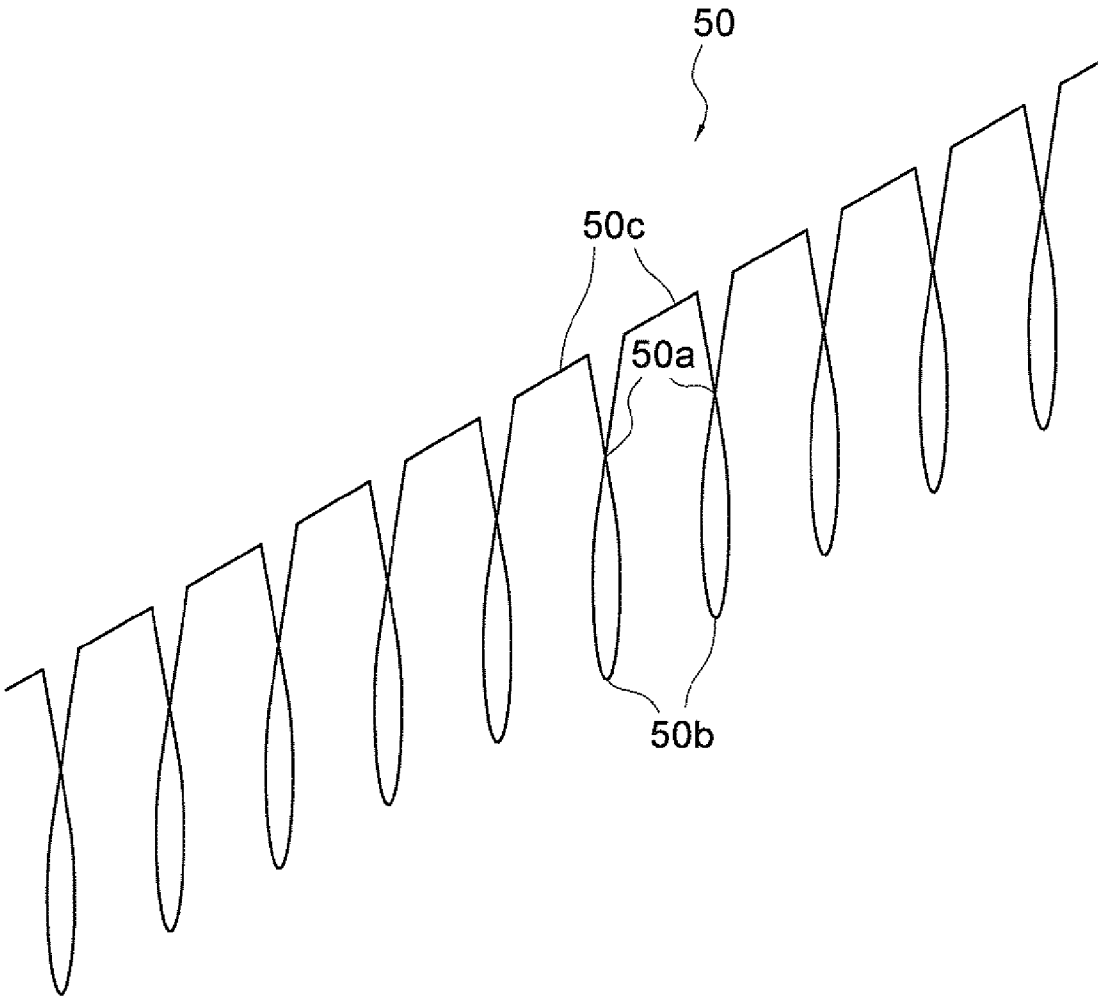
FIG. 9 is a perspective view showing a toner removing member of a developing device according to a third embodiment of the present invention.

Meanwhile, residual toner on the surface of the photoconductor 11 that remains after the transfer operation is removed by the cleaning device 16. The cleaning device 16 has a blade 16*a* brought into contact with the surface of the photoconductor 11 as shown in FIG. 2 and FIG. 9, described later, for scraping the residual toner off the surface of the photoconductor 11, a container 16*b* for receiving the scraped toner, and a toner conveyance spiral member 16*d*. The toner conveyance spiral member 16*d* is provided in the container 16*b* in order to convey toner in one direction of the container 16*b*, and discharge the toner from an opening 16*c* formed at the end of the container 16*b* to the outside. Then, in the container 16*b*, the scraped toner is conveyed by the toner conveyance spiral member 16*d* in the longitudinal direction F of a shaft 16*e* that supports the toner conveyance spiral member 16*d* and which rotates in the direction indicated by the arrow E in the drawing, and is discharged from the opening 16*c* formed at the end of the container 16*b* to a waste toner tank (not shown).

It should be noted that the charge remaining on the surface of the photoconductor 11 is removed by the discharge device 17, and the photoconductor 11 is charged again by the charge device 12 in order to perform a successive image forming process described above.

Figure 3:
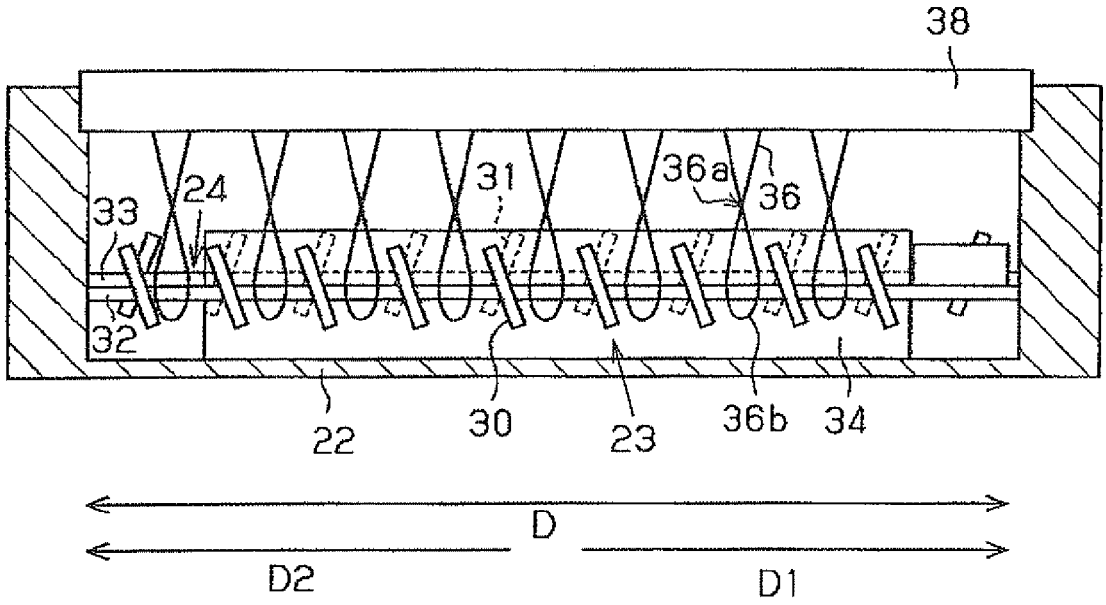
FIG. 3 is a front view of a spiral member provided in the developing device shown in FIG. 2 as viewed from the side opposite a photoconductor.
Figure 4D:
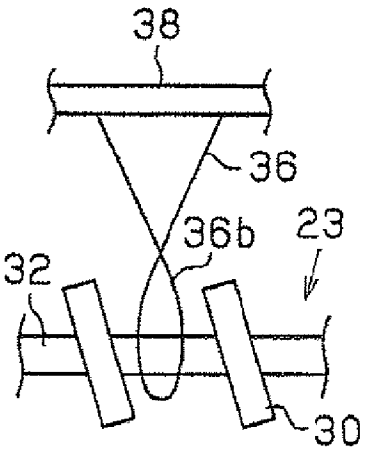
FIGS. 4A-4D are schematic diagrams explaining a process of removing attached toner by means of a toner removing member of the developing device according to the first embodiment of the present invention.
Figure 4C:
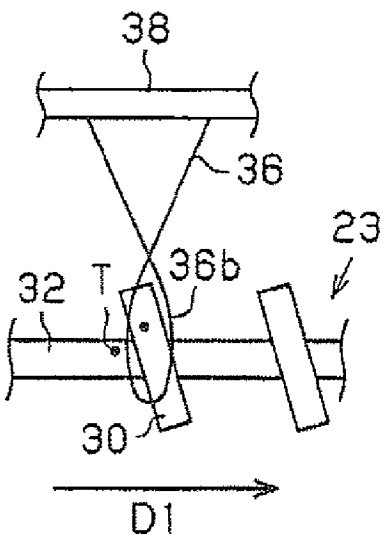
Figure 4B:
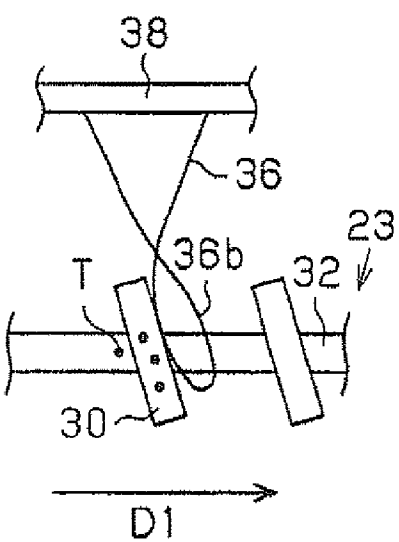
Figure 4A:
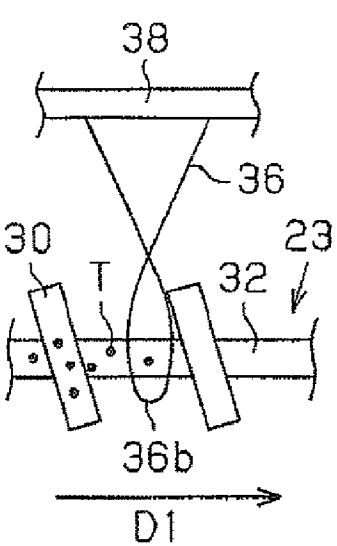

Next, a description of the developing device will be provided with reference to the drawings. FIG. 2 is a cross-sectional view showing a developing device in the first embodiment of the present invention. FIG. 3 is a front view of a spiral member provided in the developing device shown in FIG. 2 as viewed from the side opposite the photoconductor.

As shown in FIG. 2 and FIG. 3, the developing device 14 in this embodiment has a container 22 which receives a supply of the toner and contains the toner. The container 22 has an agitation chamber 40 for agitating the toner, and a developing chamber 41 including a developing roller 27, described later, for guiding the toner toward the surface of the photoconductor 11. The developing device 14 also has a first spiral member 23. The first spiral member 23 has a shaft 32 (a rotatable first shaft) placed within the agitation chamber 40 and a spiral shaped blade 30 (see FIG. 3) formed on the outer circumference of the shaft 32, and conveys toner in the longitudinal direction of the shaft 32 (in the direction indicated by the arrows D in FIG. 3) by means of the rotation thereof in the direction indicated by the arrow A. Additionally, the developing device 14 is provided with a second spiral member 24. The second spiral member 24 is placed within the developing chamber 41, and has a shaft 33 (a rotatable second shaft) arranged to be substantially parallel with the shaft 32 and a spiral shaped blade 31 on the outer circumference of the shaft 33, and conveys the toner in the longitudinal direction of the shaft 33 (in the direction indicated by the arrows D in FIG. 3) by means of the rotation thereof in the direction indicated by the arrow B in the drawing.

It should be noted that the first spiral member 23 and the second spiral member 24 are arranged to be substantially parallel with each other. Also, between the first spiral member 23 and the second spiral member 24 is provided a partition member 34 for partitioning the container into the agitation chamber 40 and the developing chamber 41 such that the agitation chamber 40 and the developing chamber 41 are in communication therebetween.

In addition, a developing roller (or toner carrying roller) 27 is provided. The developing roller 27 includes a fixed magnetic roller 25, and a non-magnetic developing sleeve 26. The fixed magnetic roller 25 is provided at the opening side of the container 22 and has a plurality of magnetic poles. The developing sleeve 26 encloses the fixed magnetic roller 25 and is pivotally supported in order to guide the contained toner to the surface of the photoconductor 11. Furthermore, a magnetic blade 28 is placed adjacent the developing sleeve 26 and hangs toward the top surface of the developing sleeve 26. The magnetic blade 28 is made of magnetic material. Magnetic sealing members 29 are located at the ends of the developing sleeve 26 in the longitudinal direction of the developing sleeve 26. A magnet 35 is attached on a side surface of the magnetic blade 28 on the container 22 side, and has a lower edge with an S polarity. A source (not shown) is provided for applying a developing bias voltage to the developing roller 27.

On a top surface of the container 22 above the first spiral member 23 is formed a toner supply opening (not shown) through which toner can be supplied by a toner cartridge (not shown). The supplied toner is agitated and carried by the first spiral member 23 within the agitation chamber 40 from left to right (that is, in the direction of an arrow D1 in the drawing) in FIG. 3, to the developing chamber 41. Then, the toner conveyed to the developing chamber 41 is agitated and conveyed by the second spiral member 24 within the developing chamber 41 from right to left (that is, in the direction of an arrow D2 in the drawing) in FIG. 3, and is guided to the developing sleeve 26. The toner guided to the developing sleeve 26 is supported on the developing sleeve 26 by utilizing the magnetic force of the fixed magnetic roller 25. The thickness of the toner is controlled by the magnetic blade 28 placed adjacent to the developing sleeve 26 and functioning as a toner thickness control member. Thereafter, the toner supported on the developing sleeve 26 is guided to a developing position, that is, the surface of the photoconductor 11, by the developing roller 27.

The developing sleeve 26 is set to rotate at a predetermined peripheral velocity, and the developing sleeve 26 is set to rotate in the same direction between the drum and the sleeve (that is, in the direction of arrow C) as the rotating direction X of the photoconductor 11. Also, the developing sleeve 26 is placed at a predetermined distance from the photoconductor 11.

It should be noted that the magnetic poles of the fixed magnetic roller 25 are arranged as shown in FIG. 2: a developing pole S1 adjacent to the developing position; a pulling pole N1 adjacent to the developing pole S1; a carrying pole S2 adjacent to the pulling pole N1; a draw-up pole N2 adjacent to the carrying pole S2; a blade pole S3 adjacent to the draw-up pole N2; and a toner scattering prevention pole N3 adjacent to the blade pole S3.

The magnetic sealing members 29 are provided for preventing the toner from leaking from the ends in the longitudinal direction of the developing sleeve 26, and are provided at a fixed distance from the outer surface of the developing sleeve 26 at both ends in the longitudinal direction of the developing sleeve 26.

This embodiment is characterized in that a toner removing member for removing the toner is attached to the first and second spiral members 23 and 24. A detailed description will be provided below with reference to the drawings. FIGS. 4A to 4D are schematic diagrams explaining a process of removing attached toner by a toner removing member in the developing device according to the first embodiment of the present invention.

As shown in FIG. 2, in this embodiment, toner removing members 36 and 37 are provided for removing toner attached to the first and second spiral members 23 and 24, respectively. More specifically, the toner removing members 36 are provided such that at least parts of them are brought into contact with the surface of the first spiral member 23 within the container 22. The toner removing members 36 are supported by a support member 38 attached to an inner side of the container 22. Similarly, the toner removing members 37 are provided such that at least parts of them are brought into contact with the surface of the second spiral member 24 within the container 22. Each toner removing member 37 is supported by the support member 38 attached to the inner side of the container 22. It should be noted that the toner removing members 36 and 37 are made of a metal wire material having elasticity (SUS 304, for example).

As shown in FIG. 3, each toner removing member 36 has a twist portion 36*a* and a portion 36*b* (hereinafter, referred to as a "toner scraping portion 36*b*") that is in contact with the surface of the first spiral member 23. The toner scraping portion 36*b* is substantially oval shaped when viewed from the front side in a direction that is orthogonal to the longitudinal direction D of the shaft 32 of the first spiral member 23 (in the directions of arrows Y1 and Y2 in FIG. 2). A virtual plane of the oval-shaped toner scraping portion 36 is arranged so as to be parallel with the shaft 32 of the first spiral member 23.

Although FIG. 3 shows only the toner removing members 36, the toner removing members 37 also take the same shape as the toner removing members 36. That is, each toner removing member 37 has a twist portion (not shown) and a portion 39*a* (hereinafter, referred to as "toner scraping portion 39*a*") that is in contact with the surface of the second spiral member 24. The toner scraping portion 39*a* is substantially oval shaped as viewed from the front side in directions that are orthogonal to the longitudinal direction D of the shaft 33 of the second spiral member 24 (in directions of arrows Z1 and Z2 in FIG. 2).

In the above-described construction, by taking the toner removing members 36 as an example, a process of removing attached toner by the toner removing members 36 will be described referring to FIGS. 4A to 4D.

First, as the first spiral member 23 rotates, the spiral shaped blade 30 looks as if it is moving in the direction of the arrow D1, and shifts from a state (1) to a state (2). Here, the toner scraping portions 36*b*, being in contact with the shaft 32 of the first spiral member 23, scrape the toner T off the surface of the shaft 32 and remove it, and receive a force from the blade 30 so as to elastically deform in the above-described direction of the arrow D1.

When the first spiral member 23 further rotates, the spiral shaped blade 30 looks as if it is moving in the direction of the arrow D1, and shifts from a state (2) to a state (3). Then, the toner scraping portions 36*b*, being in contact with the blade 30 of the first spiral member 23, receive a force from the blade 30 so as to move onto the blade 30, and move in a direction Y1 that is orthogonal to the longitudinal direction D of the shaft 32 shown in FIG. 2 to elastically deform in the orthogonal direction Y1. At this time, the toner T attached to the surface of the blade 30 is scraped off by the toner scraping portion 36*b*.

When the first spiral member 23 further rotates, the spiral shaped blade 30 looks as if it is moving in the above-described direction of the arrow D1, and shifts from a state (3) to a state (4). Then, the toner scraping portions 36*b*, being in contact with the blade 30 of the first spiral member 23, move in a direction Y2 that is orthogonal to the longitudinal direction D of the shaft 32 shown in FIG. 2, and return to the above-described state (1) from the elastically deformed state. At this time, the toner T attached to the blade 30 and the surface of the shaft 32 is scraped off and removed by the toner scraping portion 36*b*.

As described above, in this embodiment, by rotation of the first spiral member 23, the toner removing members 36 are moved in the longitudinal directions D of the shaft 32 and the directions Y1 and Y2 that are orthogonal to the longitudinal directions D of the shaft in a state in which the toner removing members 36 are in contact with the surface of the first spiral member 23. Accordingly, in comparison with the above-described conventional art, it is possible to adequately scrape the toner attached to the spiral shaped blade 30 and the shaft 32, thereby effectively preventing the aggregation of toner from occurring.

In the above-described conventional art, the toner smashing member is formed by an elastic film sheet, so that the durability of the toner smashing member with respect to the force applied while the rotary driving type conveying means rotates is reduced, resulting in a reduction in its useful life. However, in this embodiment, the toner removing members 36 are made of a metal wire material having elasticity, so that in comparison with the elastic film sheet of the above-described conventional art, the durability of the toner removing members 36 with respect to a force applied while the first spiral member 23 rotates is enhanced, thereby increasing the life of the toner removing members 36. In particular, in this embodiment, since the portions 36*b*, being in contact with the surface of the first spiral member 23, are formed so as to be substantially oval shaped when viewed from the front side by forming the twist portions 36*a* in the toner removing member 36, the durability of the toner removing members 36 to a force applied while the first spiral member 23 rotates will be further enhanced, thereby easily increasing their lifespan.

Although the toner removing members 36 were used to illustrate the process of removing attached toner by means of the toner removing members 36, the advantages of the toner removing members 37 are the same as those of the toner removing members 36, and thus a detailed description thereof is omitted here.

Second Embodiment

Next, a second embodiment of the present invention will be described. Note that the same portions as the first embodiment are labeled with similar numerals, and only portions that are different from the first embodiment will be described. The overall structure of the image forming device and the developing device is the same as those in the above-described first embodiment, and thus a detailed description thereof is omitted here.

Figure 5:
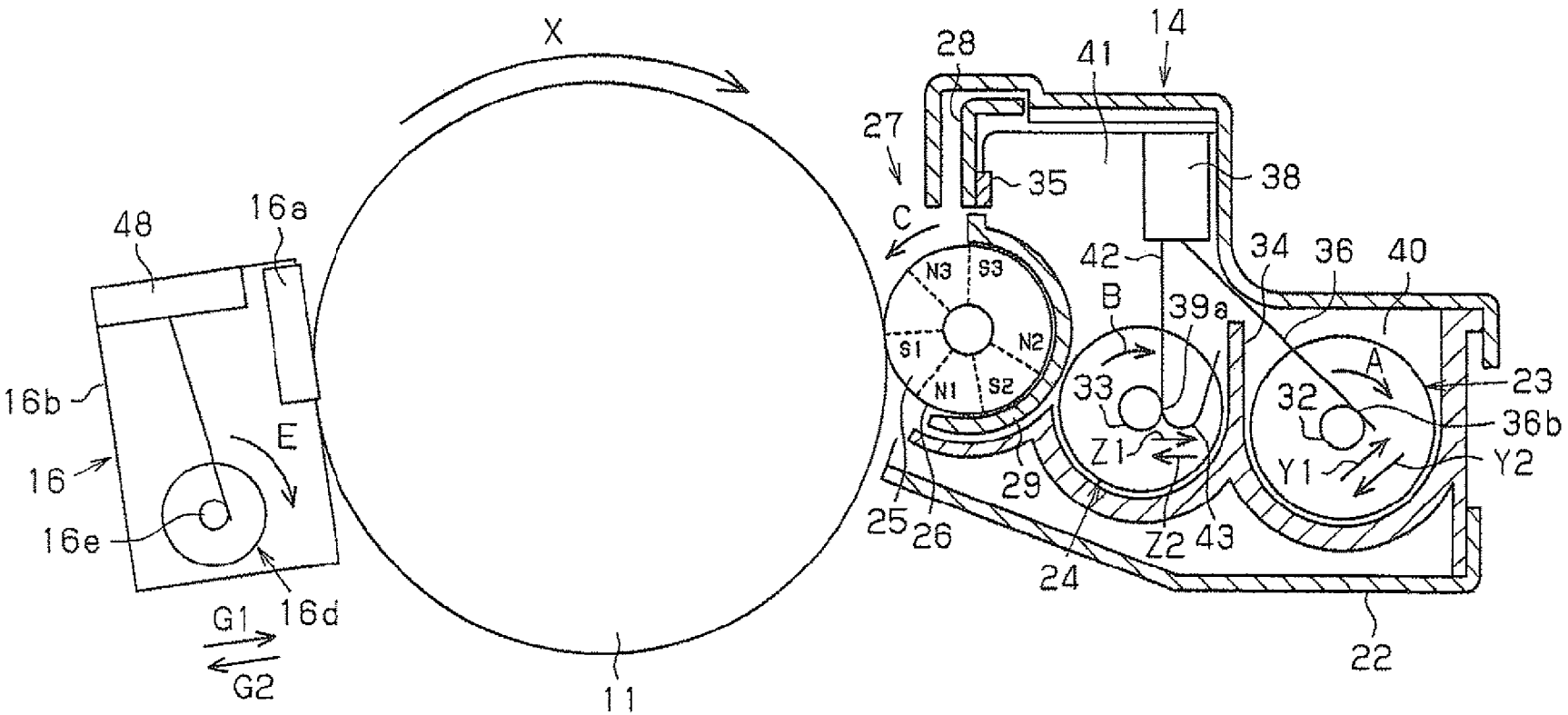
FIG. 5 is a cross-sectional view showing a developing device according to a second embodiment of the present invention.
Figure 6:
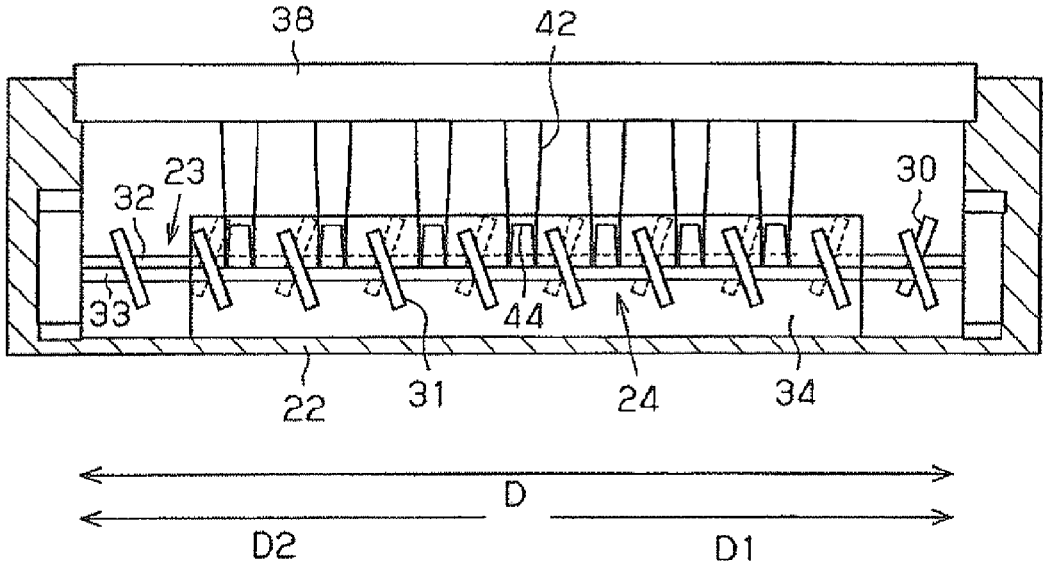
FIG. 6 is a front view of a spiral member provided in the developing device shown in FIG. 5 as viewed from the photoconductor.

This embodiment is characterized in that another toner removing member for removing the toner attached to the partition member 34 is provided in place of the toner removing members 37 utilized in the above-described first embodiment. Referring to drawings, a description will be provided below of the developing device in this embodiment. FIG. 5 is a front view showing a developing device according to the second embodiment of the present invention. FIG. 6 is a front view of the spiral member provided in the developing device shown in FIG. 5 as viewed from the photoconductor side. FIGS. 7A to 7D are schematic diagrams explaining a process of removing attached toner by a toner removing member of the developing device in the second embodiment of the present invention, and are partial enlarged views of the developing device shown in FIG. 6 as viewed from above. FIGS. 8A to 8D are schematic diagrams explaining a process of removing attached toner by a toner removing member of the developing device in the second embodiment of the present invention, and are partial enlarged views of the developing device shown in FIG. 6 as viewed from the front side.

As shown in FIG. 5, toner removing members 42 are provided for removing the toner attached to the partition member 34 like other toner removing members in this embodiment. More specifically, the toner removing members 42 are provided such that at least parts of them are in contact with the surface of the second spiral member 24 within the container 22, and are supported by a support member 38 attached to the inner side of the container 22. Also, each toner removing member 42 is formed with a bending portion 43. Each bending portion 43 bends at a portion corresponding to the second spiral member 24 and extends toward the partition member 34 to form a toner scraping portion 44 (hereinafter, to be referred to as "toner scraping portion 44") for scraping the toner attached to the surface of the partition member 34. It is noted that the toner removing member 42 is made of a metal wire material having elasticity (such as SUS 304, for example).

In the above-described construction, a process of removing attached toner on the partition member 34 by the toner removing member 42 is described. First, as the second spiral member 24 rotates, the spiral shaped blade 31 looks as if it is moving in the direction of the arrow D2 in the drawing, and shifts from states (1) in FIG. 7A and (1) in FIG. 8A to states (2) in FIG. 7B and (2) in FIG. 8B, respectively. Then, the toner removing member 42 receives a force from the blade 31 to make the toner scraping portion 44 move onto the blade 30, and to elastically deform in the direction of the arrow Z1 as described above. At this time, the toner scraping portion 44 is in contact with the surface of the partition member 34 to scrape and remove the toner T attached to the surface of the partition member 34.

Figures 7A, 7B, 7C, 7D:
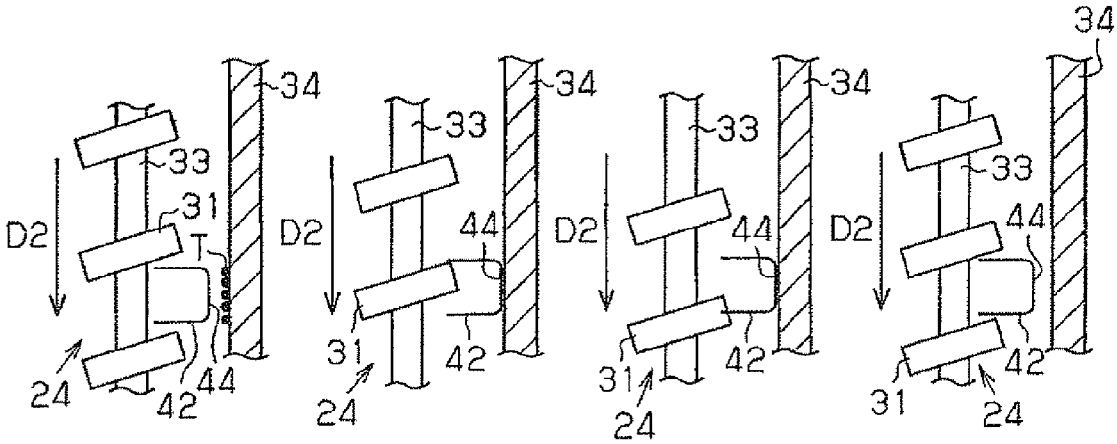
FIGS. 7A-7D are schematic diagrams explaining a process of removing attached toner by means of a toner removing member in the developing device of the second embodiment of the present invention, and is a partial enlarged view of the developing device shown in FIG. 6 as viewed from above.
Figures 8A, 8B, 8C, 8D:
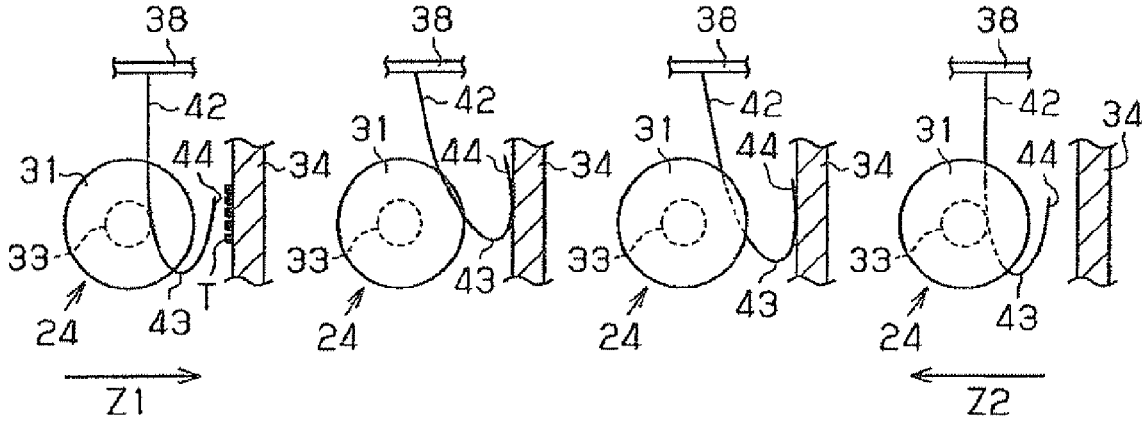
FIGS. 8A-8D are schematic diagrams explaining a process of removing attached toner by means of a toner removing member of the developing device according to the second embodiment of the present invention, and is a partial enlarged view of the developing device shown in FIG. 6 as viewed from front.

When the second spiral member 24 further rotates, the spiral shaped blade 31 looks as if it is moving in the direction of the arrow D2, and shifts from states (2) in FIG. 7B and (2) in FIG. 8B to states (3) in FIG. 7C and (3) in FIG. 8C, respectively. At this time, the toner scraping portion 44 remains elastically deformed. When the second spiral member 24 further rotates, the spiral shaped blade 31 looks as if it is moving in the direction of the arrow D2, and shifts from states (3) in FIG. 7C and (3) in FIG. 8C to states (4) in FIG. 7D and (4) in FIG. 8D, respectively. Then, the toner scraping portion 44, being in contact with the partition member 34, moves in the direction Z2 described above, and returns to the above-described states (1) in FIG. 7A and (1) in FIG. 8A from the elastically deformed state of the toner scraping portion 44.

As described above, in this embodiment, by rotation of the second spiral member 24, the toner removing member 42 is brought into contact with the surface of the partition member 34 while moving in the direction Z1 that is orthogonal to the longitudinal direction D of the shaft 33 of the second spiral member 24 in a state in which it is in contact with the surface of the second spiral member 24. Accordingly, by utilizing the toner removing member 42 in addition to the above-described toner removing member 36, it is possible to adequately scrape the toner attached to the partition member 34, in addition to the advantages described in the above-described first embodiment, thereby effectively preventing the aggregation of toner from occurring.

In this embodiment, the toner removing member 42 is made of a metal wire material having elasticity as described above so that durability to a force applied while the second spiral member 24 rotates is improved, thereby increasing the life of the toner removing member 42.

Third Embodiment

In the above-described embodiments, the toner removing member comprises a plurality of components arranged in an axial direction, and the respective components are separately attached to the support member, etc. However, each of the plurality of components is composed of a continuous member. The embodiment in this case is shown in FIG. 9.

As shown in FIG. 9, a toner removing member 50 in the third embodiment is a member for removing toner attached to each of the spiral members 23 and 24, similar to each of the above-described embodiments. The toner removing member 50 is composed of a plurality of components made of a metal wire having elasticity (SUS 304, for example). Each of the components has a twist portion 50*a*, and a toner scraping portion 50*b* that is in contact with the surface of the spiral member. Then, the respective components are made continuous by connecting portions 50*c*, and several of the connecting portions 50*c* are supported by a support member.

The toner removing member 50, in which the plurality of components are continuous with each other as described above, can be manufactured as follows.

Figure 10B:
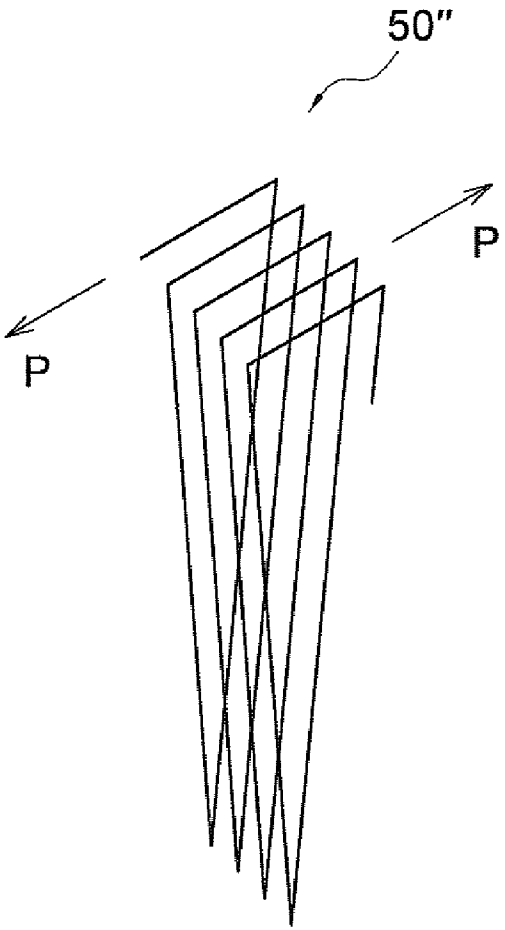
FIGS. 10A and 10B show a manufacturing method of the toner removing member according to the third embodiment of the present invention.
Figure 10A:
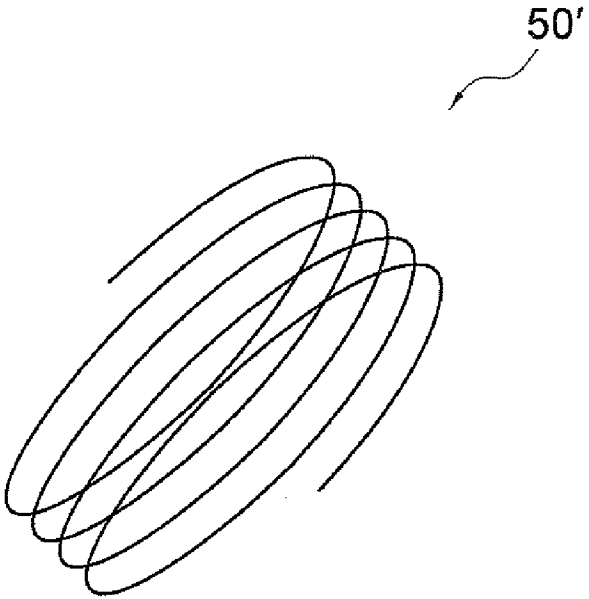

First, a coil spring 50' shown in FIG. 10A is prepared. The coil spring 50' has the number of turns needed to form the number of components necessary for the toner removing member 50. Next, the coil spring 50' is deformed to a triangle shaped continuous body 50" shown in FIG. 10B. Then, the upper side of the continuous body 50" in the drawing is cut at an appropriate position, and both ends are stretched in directions P in the drawing, that is, in the axial direction of the spiral member. As a result, the toner removing member 50 shown in FIG. 9 is obtained.

Employing a removing member like the removing member 50 facilitates its manufacture and assembly. In addition, when the toner removing member 50 is supported by a support member, the toner removing member is fixed to the support member at several points including at both ends in the longitudinal direction of the toner removing member and at the center thereof. The toner removing member is freely movable at the remaining points so that the toner scraping portion 50 can smoothly move in a longitudinal direction of the toner removing member 50*b* and in a direction that is orthogonal to the longitudinal direction of the toner removing member 50*b*.

It is noted that in the third embodiment, the toner removing member 50 is composed of one continuous body, but the continuous body 50" may be divided into several members.

Fourth Embodiment

Figure 11:
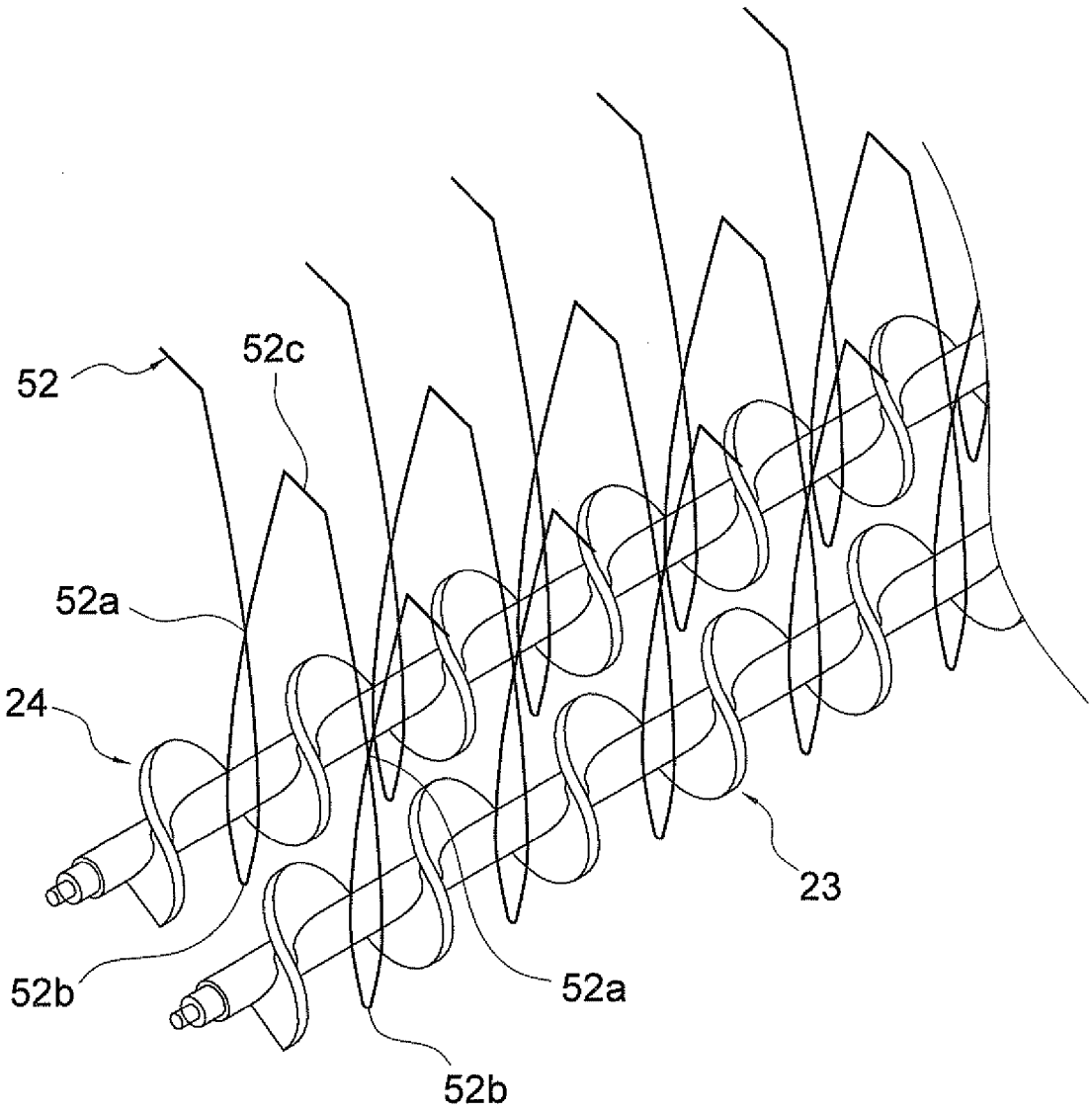
FIG. 11 is a perspective view showing a toner removing member of a developing device according to a fourth embodiment of the present invention.

In the third embodiment, although the toner removing member 50, composed of a continuous component, is arranged along the axial direction of the spiral member, it may be arranged along the direction of arrangement of the two spiral members 23 and 24 as shown in FIG. 11.

Each of the toner removing member 52 in this embodiment comprises two components made of an elastic metal wire (SUS 304, for example), each of the components having a twist portion 52*a* and a toner scraping portion 52*b* that is in contact with the surface of the spiral member. Then, the two components are made continuous by a connecting portion 52*c*. Each toner scraping portion 52*b* is formed to be substantially oval shaped when viewed in the axial direction, and the plane including the oval shape is arranged so as to be orthogonal to the shafts of the spiral members 23 and 24.

In this embodiment, the toner removing member 52 can smoothly move or deform in a direction along the shafts of the spiral members 23 and 24. In addition, since the two components are continuous in a direction that is orthogonal to the shaft, the toner removing member 52 can move or deform with ease.

Fifth Embodiment

Figure 12:
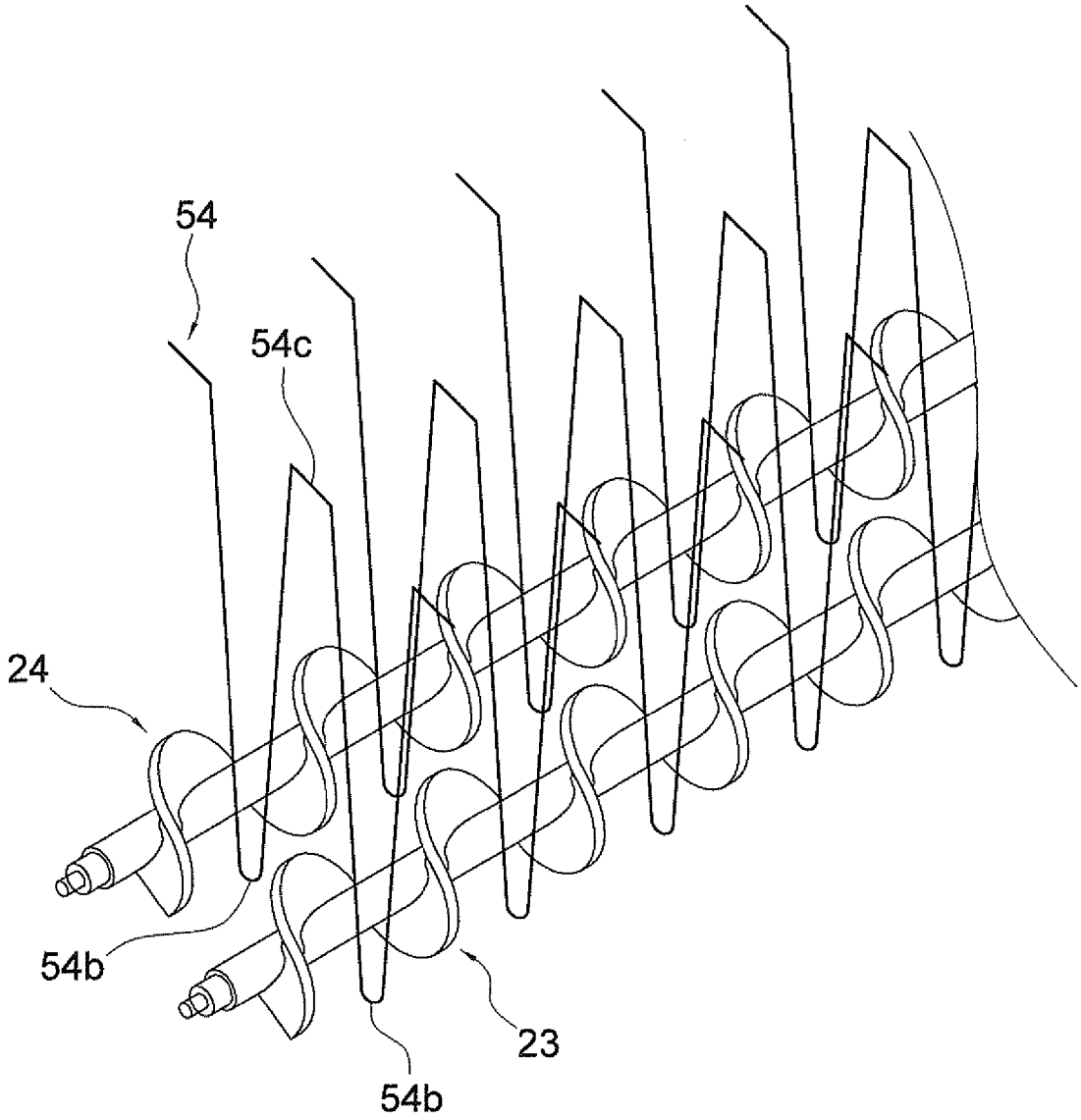
FIG. 12 is a perspective view showing a toner removing member of a developing device according to a fifth embodiment of the present invention.

Another embodiment is shown in FIG. 12 in which the toner removing member in the fourth embodiment is changed in shape. The toner removing member 54 in this embodiment is composed of two continuous components as described above, and the two components are arranged in a direction along the arrangement of the two spiral members 23 and 24.

The toner removing member 54 in this embodiment does not have a portion corresponding to a twist portion, unlike the above-described embodiments, and has toner scraping portions 54*b* that are in contact with the surfaces of the spiral members and a connecting portion 54*c* connecting the two components. Each toner scraping portion 54*b* is formed to be substantially V-shaped when viewed in the axial direction, and the plane including the V-shape is arranged so as to be orthogonal to the shafts of the spiral members 23 and 24.

In this embodiment too, the toner removing member 54 can smoothly move or deform, especially in directions along the shafts of the spiral members 23 and 24, and in directions that are orthogonal to the shafts.

Other Embodiments

In the above-described fourth and fifth embodiments, the plane including the toner scraping portion of the toner removing member 54 is arranged so as to be orthogonal to the shaft of the spiral member, and both of them are connected with each other. However, the two components may separately be arranged.

Figure 13:
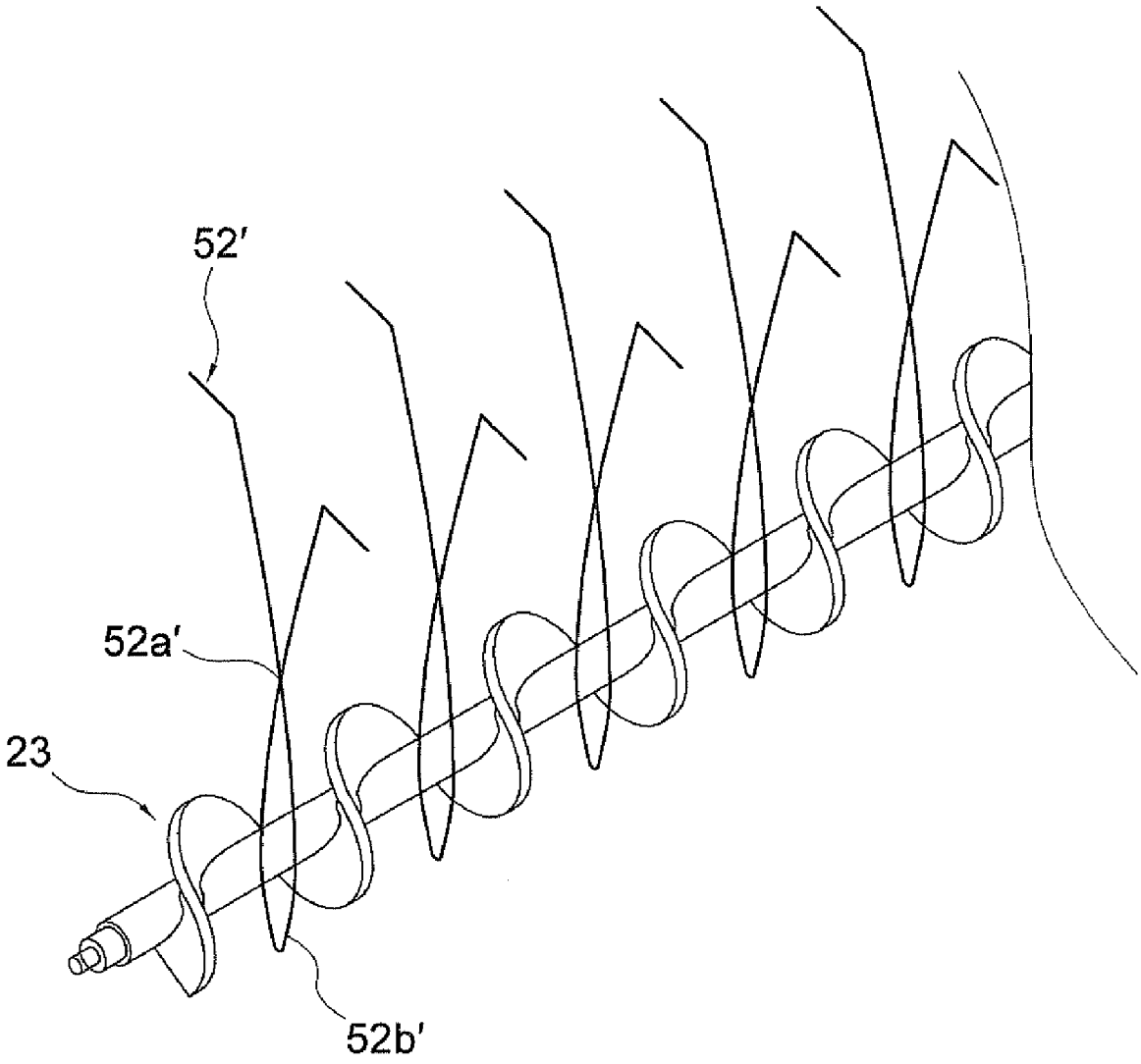
FIG. 13 is a perspective view showing a toner removing member in a developing device according to another embodiment of the present invention.
Figure 14:
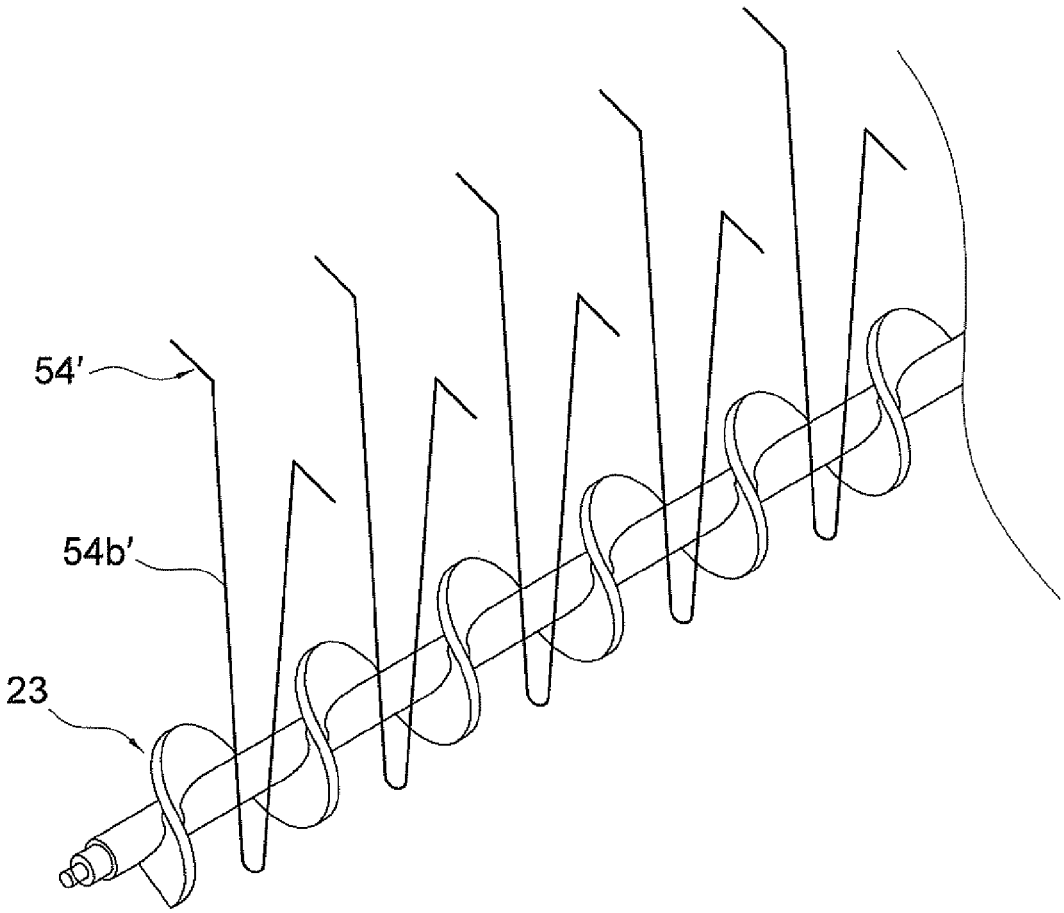
FIG. 14 is a perspective view showing a toner removing member of a developing device according to another embodiment of the present invention.

The embodiment in this case is shown in FIG. 13 and FIG. 14. Here, in order to remove the toner on the spiral member 23, toner removing members 52' and 54' are provided. These toner removing members 52' and 54' are the same as parts of the toner removing members 52 and 54 shown in FIG. 11 and FIG. 12, respectively.

That is, each toner removing member 52' and 54' is made of an elastic metal wire (SUS 304, for example), and each toner removing member 52' has a twist portion 52*a*' and a toner scraping portion 52*b*' that is in contact with the surface of the spiral member. Each toner scraping portion 52*b*' is formed to be substantially oval shaped when viewed in the axial direction, and the plane including the oval shape is placed so as to be orthogonal to the shaft of the spiral member 23.

Furthermore, the toner removing member 54' does not have a portion corresponding to a twist portion, and has a toner scraping portion 54*b*' that is in contact with the surface of the spiral member. The toner scraping portion 54*b*' is formed in an approximate V-shape as viewed in the axial direction, and the plane including the V-shape is arranged so as to be orthogonal to the shaft of the spiral member 23.

It should be noted that the above-described embodiment is cited by way of example, but the scope of the present invention is not limited to the above-described embodiments, and can be changed in shape, dimension, material, etc. of each component on the basis of the object of the present invention, and the changes are not excluded from the scope of the present invention.

Figure 15:
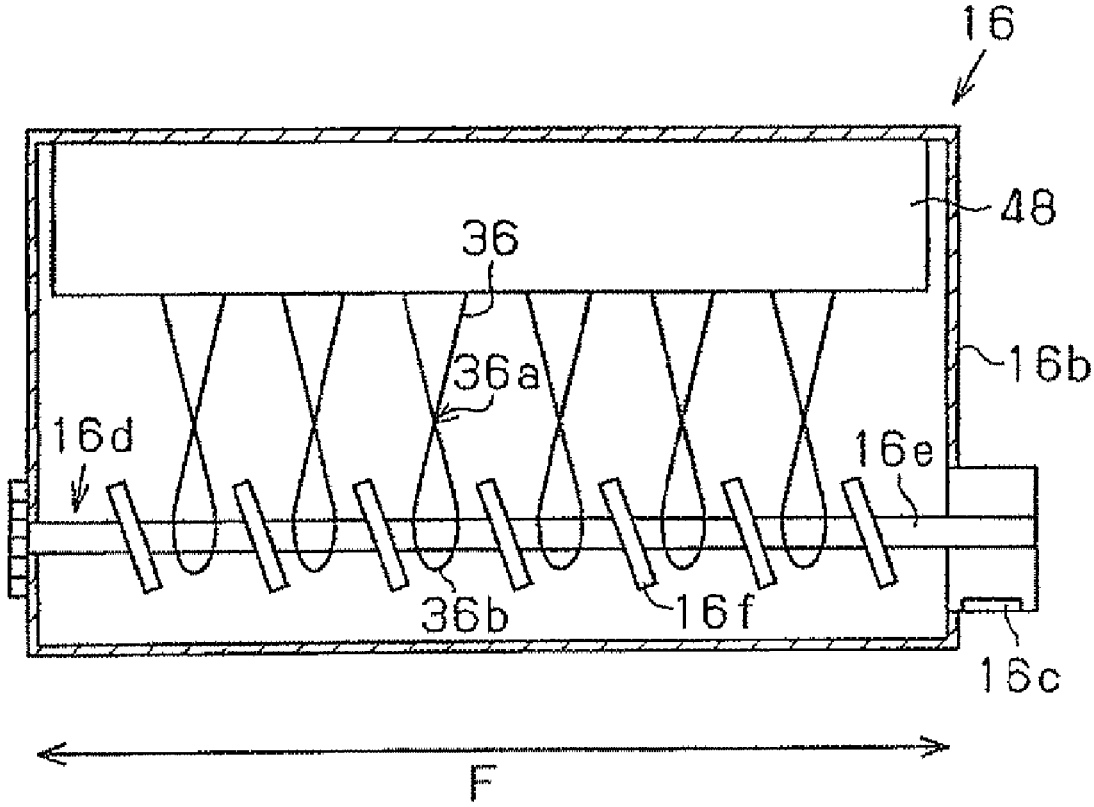
FIG. 15 is a view showing a situation in which a toner removing member is provided in the cleaning device shown in FIG. 2.

For example, the above-described toner removing member may be provided in the cleaning device 16. FIG. 15 is a view showing a state in which a toner removing member is provided in the cleaning device shown in FIG. 2. FIG. 15 shows a construction in which the above-described toner removing member 36 is provided in the cleaning device 16 for removing toner attached to the toner conveyance spiral member 16*d*. More specifically, the toner removing member 36 is provided such that at least a part of the toner removing member 36 is in contact with the surface of the toner conveyance spiral member 16*d* within the container 16*b*, and is supported by a support member 48 attached to the inner side of the container 16*b*. Then, as the toner conveyance spiral member 16*d* rotates, the toner removing member 36 moves in the longitudinal directions F of the shaft 16*e* of the toner conveyance spiral member 16*d* and in directions G1 and G2 (see FIG. 2) orthogonal to the longitudinal direction F in a state in which the toner removing member 36 is in contact with the surface of the toner conveyance spiral member 16*d*. Accordingly, it is possible to sufficiently scrape the toner attached to the spiral shaped blade 16*f* and the shaft 16*e*, thereby effectively preventing the aggregation of toner from occurring in the cleaning device 16 also.

In the above-described embodiment, although the toner scraping portion of the toner removing member is substantially oval shaped or substantially V-shaped when viewed from the front side, any shape which is able to adequately scrape the attached toner is appropriate. For example, the toner scraping portion may be substantially triangle shaped, substantially square shaped, etc. when viewed from the front side. When such shapes are employed, the durability of the toner removing member to a force applied while the toner conveyance spiral member rotates is dramatically improved, similar to the case of employing the above-described substantially oval shaped and substantially V-shaped members. As a result, the life of the toner removing member 36 is increased.

In the above described embodiment, although a digital copier is shown as one example of the image forming device, it is needless to say that other image forming devices such as a facsimile, a printer, etc. can be employed.

The present invention relates to developing devices which develops an image with toner in an electrophotographic developing method as an application example. More specifically, the present invention is directed to a developing device which can prevent an aggregation of toner from occurring, and an image forming device having the same.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2005-089217. The entire disclosure of Japanese Patent Application No. 2005-089217 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A toner conveying device for conveying toner in one direction, comprising:

a container for containing toner;

a spiral member comprising a rotatable shaft provided within the container and a spiral shaped blade formed on an outer circumference of the shaft, the spiral member being configured to rotate and to convey the toner in a longitudinal direction of the shaft; and a toner removing member including a twisted portion and a toner scraping portion, the toner scraping portion being arranged to contact the rotatable shaft and the spiral shaped blade of the spiral member when the spiral member is rotated in order to remove toner attached to the spiral member.

2. The toner conveying device according to claim 1, wherein the toner removing member is comprised of an elastic metal wire.

3. The toner conveying device according to claim 2, wherein the toner scraping portion extends toward the shaft of the spiral member so as to be in contact with the surface of the spiral member.

4. The toner conveying device according to claim 3, wherein the toner scraping portion having substantially an oval shape.

5. The toner conveying device according to claim 3, wherein a virtual plane defined by the toner scraping portion is parallel with the shaft of the spiral member.

6. The toner conveying device according to claim 1, further comprising a support member arranged along the axial direction of the spiral member; and the toner removing member comprises a plurality of toner scraping portions which are inserted between adjacent blade portions of the spiral member and capable of contacting the surface of the spiral member, and a support portion for supporting the plurality of toner scraping portions on the support member.

7. The toner conveying device according to claim 6, wherein each of the plurality of toner scraping portions is formed to be continuous.

8. The toner conveying device according to claim 7, wherein the toner removing member is formed such that both ends of a coil spring having a plurality of turns in a predetermined shape extend in the axial direction of the spiral member.

9. The toner conveying device according to claim 7, wherein the toner removing member is formed such that both ends of a coil spring having a plurality of turns in a predetermined shape extend in a direction that is orthogonal to the axial direction of the spiral member.

10. A developing device for forming a toner image on an image support member provided in an image forming unit of an image forming device, comprising:

a container for containing toner;

a developing roller supported in the container for supplying the image support member with toner;

a spiral member comprising a rotatable shaft provided within the container and a spiral shaped blade formed on an outer circumference of the shaft, the spiral member being configured to rotate and to convey the toner in a longitudinal direction of the shaft; and a first toner removing member including a twisted portion and a first toner scraping portion, the toner scraping portion being arranged to contact the rotatable shaft and various parts of the spiral shaped blade of the spiral member when the spiral member is rotated in order to remove toner attached to the spiral member.

11. The developing device according to claim 10, wherein the toner removing member is made of an elastic metal wire.

12. The developing device according to claim 11, wherein the first toner scraping portion extends toward the shaft of the spiral member so as to be in contact with the surface of the spiral member.

13. The developing device according to claim 10, wherein the container further comprises an agitation chamber for receiving a supply of toner and agitating the toner, and a developing chamber provided with a developing roller for guiding the toner to the surface of the photoconductor;

the developing device further comprising:

a partition member for partitioning the container into the agitation chamber and the developing chamber such that the agitation chamber and the developing chamber are in communication with each other; and a second toner removing member for removing toner attached to the partition member, the second toner removing member being configured to simultaneously contact the surface of the spiral member and the surface of the partition member during rotation of the spiral member.

14. The developing device according to claim 13, wherein the second toner removing member is made of an elastic metal wire.

15. The developing device according to claim 14, wherein the second toner removing member has a toner scraping portion which extends toward the shaft of the spiral member so as to be in contact with the surface of the spiral member.

16. An image forming device, comprising:

a sheet feeding unit comprising a sheet storage unit that stores sheets to be dispatched therefrom;

a sheet conveyance unit for conveying a sheet from the sheet feeding unit;

an image forming unit for forming a toner image on the sheet conveyed from the sheet conveyance unit, the image forming unit comprising an image support member having a surface on which an electrostatic latent image is formed on the basis of image data, and a developing device for forming a toner image on the image support member; and a fixing unit for fixing the toner image formed on the sheet by the image forming unit;

the developing device further comprising:

a container for containing toner;

a developing roller supported in the container for supplying the image support member with toner;

a spiral member comprising a rotatable shaft provided within the container and a spiral shaped blade formed on an outer circumference of the shaft, the spiral member being configured to rotate and to convey the toner in a longitudinal direction of the shaft by means of rotation; and a toner removing member including a twisted portion and a toner scraping portion, the toner scraping portion being arranged to contact the rotatable shaft and various parts of the spiral shaped blade of the spiral member when the spiral member is rotated in order to remove toner attached to the spiral member.

17. The image forming device according to claim 16, wherein the toner removing member is made of an elastic metal wire.

18. The image forming device according to claim 17, wherein the toner scraping portion extends toward the shaft of the spiral member so as to be in contact with the surface of the spiral member.

* * * * *